US006545592B2

(12) United States Patent
Weiner

(10) Patent No.: US 6,545,592 B2
(45) **Date of Patent: *Apr. 8, 2003**

(54) MEDICATION REMINDER DEVICE

(76) Inventor: Steven L. Weiner, 1850 Mt. Diablo Blvd., #620, Walnut Creek, CA (US) 94596

( * ) Notice: Subject to any disclaimer, the term of this patent is extended or adjusted under 35 U.S.C. 154(b) by 0 days.

This patent is subject to a terminal disclaimer.

(21) Appl. No.: 09/850,227

(22) Filed: May 7, 2001

(65) Prior Publication Data

US 2001/0040500 A1 Nov. 15, 2001

Related U.S. Application Data

(63) Continuation-in-part of application No. 09/407,006, filed on Sep. 28, 1999, now Pat. No. 6,229,431.
(60) Provisional application No. 60/102,189, filed on Sep. 28, 1998.

(51) Int. Cl.[7] ..... G08B 1/00
(52) U.S. Cl. ..... 340/309.15; 340/309.48; 340/25.17; 368/10; 368/107; 368/109; 368/278
(58) Field of Search ..... 340/309.15, 309.4, 340/825.17; 368/10, 107, 109, 278

(56) References Cited

U.S. PATENT DOCUMENTS

| | | | | |
|---|---|---|---|---|
| 4,419,016 A | | 12/1983 | Zoltan | |
| 4,504,153 A | | 3/1985 | Schollmeyer et al. | |
| 4,731,765 A | | 3/1988 | Cole et al. | |
| 4,768,176 A | | 8/1988 | Kehr et al. | |
| 4,849,948 A | | 7/1989 | Davis et al. | |
| 4,905,213 A | | 2/1990 | Masse et al. | |
| 4,939,705 A | | 7/1990 | Hamilton et al. | |
| 5,016,230 A | | 5/1991 | Seifers et al. | |
| 5,233,571 A | * | 8/1993 | Wirtschafter | 340/309.15 |
| 5,625,334 A | * | 4/1997 | Compton | 340/309.15 |
| 5,751,660 A | | 5/1998 | Chappell | |
| 5,751,661 A | * | 5/1998 | Walters | 368/10 |
| 5,815,586 A | * | 9/1998 | Dobbins | 381/124 |
| 5,953,288 A | | 9/1999 | Chappell | |
| 6,084,504 A | * | 7/2000 | Rosche et al. | 340/309.15 |

* cited by examiner

*Primary Examiner*—Daniel J. Wu
*Assistant Examiner*—Hung Nguyen
(74) *Attorney, Agent, or Firm*—Richard Esty Peterson

(57) ABSTRACT

A medication reminder device having a cap unit with a timer dial for selecting a period between alarm signals and a start and reset button with a light, the cap unit having internal electronics with a power supply to generate an alarm signal that is preferably visible, using the button light; audio, using a sound generating circuit; and physical, using a vibrator mechanism; the cap unit being connected to a compact container with a compartment for storage of pills, the compact container having an adaptor cap for connecting the assembled device to a standard prescription container.

19 Claims, 4 Drawing Sheets

MEDICATION REMINDER DEVICE

This application is a continuation-in-part of Ser. No. 09/407,006 filed Sep. 28, 1999, now U.S. Pat. No. 6,229,431 issued May 8, 2001 which claims the benefit of U.S. Provisional Application No. 60/102,189 filed Sep. 28, 1998.

BACKGROUND OF THE INVENTION

This invention relates to an inexpensive medication reminder for pills including capsules, tablets, and-the-like that are typically supplied by a pharmacist in standard plastic pill containers.

The standard plastic pill container is designed to be disposable and customarily includes a top with a child proof lock. Patients frequently are required to take multiple medications of different types, and in many cases the medications should be taken at different times after different time intervals. For example, one medication may be required to be taken morning and evening, and another only at night before sleep.

The solution to this problem is a medication reminder device that is sufficiently inexpensive to be utilized for each medication container. Each reminder device can therefore include an alarm that can be separately timed to indicate when a medication associated with that device is to be taken.

A problem with a medication reminder device for each medication container is the requirement of carrying the entire container. While this may not be a concern for a single container, again, where multiple different medications are involved, carrying multiple pill containers can be a burden.

The medication reminder device of this invention solves these problems in an economical and convenient manner. Each reminder device has a small compartment for carrying a few pills from the main container, and can be conveniently separated from the main container as a small travel case. These and other features are described.

SUMMARY OF THE INVENTION

The medication reminder device of this invention comprises a pill container cap assembly with a timer and alarm, the cap assembly including a cap portion in which the micro electronics for the timer and alarm features are encased, and a detachable container portion having a compartment in which a small quantity of pills can be stored. The container portion includes a detachable adaptor cap having an engagement mechanism that is compatible with a conventional pill container typically used by a pharmacy in prescribing prescription drugs. The discardable prescription container customarily has a locking cap mechanism to prevent opening by small children. The detachable adaptor cap is designed to engage the prescription container in the same manner as the original cap. The adaptor cap is connected to the container portion of the reminder device, and detaches from the device when the reminder device is separated from the primary container for use of the device as a travel case with, for example, a days supply of pills in the pill compartment.

In this manner, the original pill container cap need not be retained and can be discarded. The travel compartment of the reminder device is preferably tinted, but transparent to both protect the contents from UW light yet permit visual inspection of the contents. In situations where more than one reminder device is used by an individual this permits the proper reminder device to be matched with the proper pill container when pills remain in the travel compartment.

The timer and alarm components are integrated into the cap portion of the assembly. The components are designed and arranged for simplicity in use. In one embodiment the cap portion has a twist dial to select one of multiple positions corresponding to time periods for periodic activation of the alarm features. One position is reserved for off, which disables the device to protect the battery from running down when the device is not in use.

In the center of the cap is a button switch that includes a light that is activated when the device is in the alarm mode. The button switch starts the time period selected by the twist dial. Preferably, the button switch also interrupts the alarm mode to re-start the time period.

In another embodiment the time periods are preset by the pharmacist. In this embodiment the twist dial is used to advance or retard the alarm, for example, by one-half hour ahead or behind the preset periods. This embodiment permits time periods that are not uniform to be set.

In an additional embodiment the main pill supply container is modified from the conventional container and comprises an integral component of the reminder device. The modified pill supply container permits greater versatility in use of the electronic cap and adaptor cap. Also, the electronic cap of this alternate embodiment includes a small electronic display screen that displays the current time and the time of the next dose. In addition, the electronic display screen displays the total number of doses to be taken during a day and the number of doses already taken. The electronic display screen is centered in the cap and the button switch is positioned above the screen to maximize the area in the top of the cap available for the small electronic display screen.

In the preferred embodiments, the alarm feature has multiple means of signaling that it is time to take a pill. In addition to the light in the button switch, the reminder device has an audible alarm and a physical vibrator. Preferably, the reminder device is in the alarm mode for a preset time period, for example, thirty seconds. During this period the audible alarm, for example, a periodic chime, and/or the vibrator are activated along with the light. In this manner the alarm can be detected when the reminder device is in the user's pocket. Depressing the button switch stops the alarm to prevent the alarm feature from being an annoyance after detection. In the first embodiment the time period before taking the next medication is again started and, using the button as an alarm interrupt, will function as a timer reset. If the alarm mode runs its full duration, the period before the next alarm automatically restarts at the end of the alarm mode. In this manner a reminder device left unattended will not exhaust the power supply by remaining in the power consuming alarm mode.

The reminder device is designed to utilize a small battery and micro circuitry to minimize the size of the electronic components.

DETAILED DESCRIPTION OF THE PREFERRED EMBODIMENT

Figure 1:
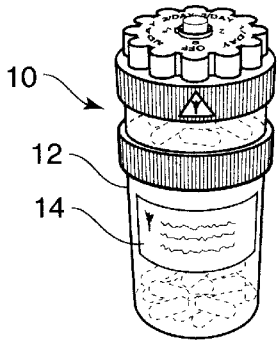
FIG. 1 is a side perspective view of the reminder device installed on a conventional pill container.
Figure 3:
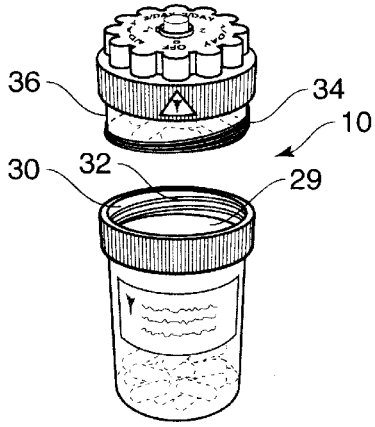
FIG. 3 is a partially exploded view showing the reminder device separated into a travel container and covered pill container.

Referring to the drawings, the reminder device of this invention, designated generally by the reference numeral 10, is shown in a first embodiment in FIG. 1 connected to a conventional prescription container 12. The prescription container 12 includes its original prescription label 14, which customarily has an identification of the medication contained, and the directions for taking the medication. This is one advantage of the subject reminder device in that the original labeled container is utilized to prevent errors in filling an unmarked specialty bottle. The prescription container 12 has a top rim 16 with a locking mechanism 18 in the form of notched teeth 20. This mechanism 18 engages a similar locking mechanism (not visible) in an adaptor cap 22, that is part of three separable components making up the assembly of the reminder device 10.

Figure 2:
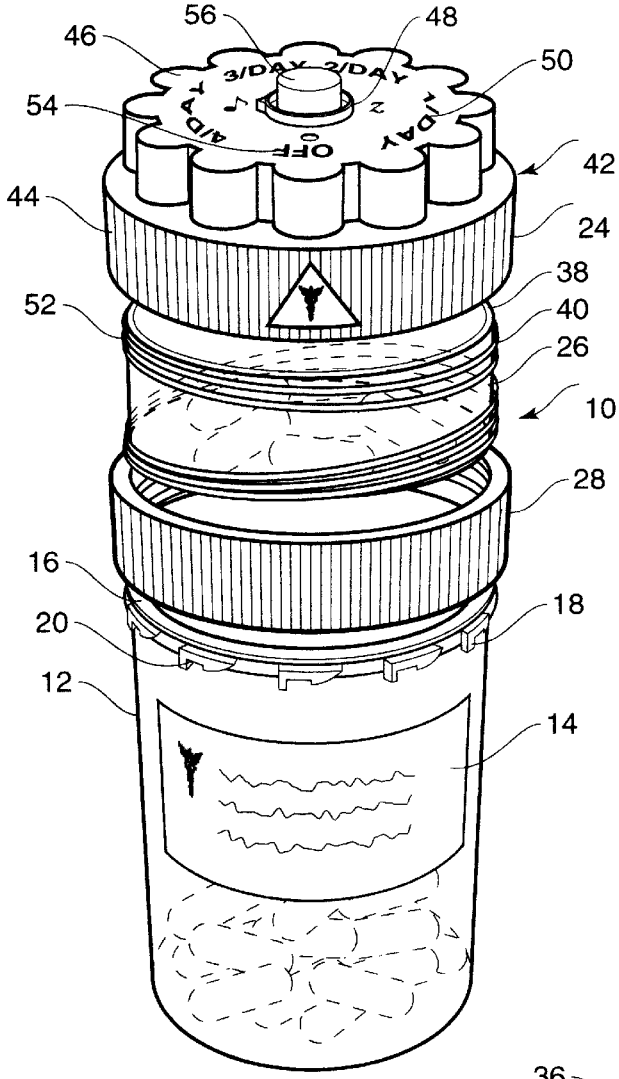
FIG. 2 is an exploded view of the reminder device of FIG. 1 showing the three detachable components of the device.

The reminder device 10 is an assembly that includes an alarm and timer cap portion 24, a travel container portion 26 and an adaptor portion 28, which are shown separated in FIG. 2. The adaptor cap 22 has a center divider 29 with one side of the cap 22 having the locking mechanism for the standard pill container and an opposite side having a recess with internal threads 32 that engage external threads 34 on a travel container 36. The travel container 36 is separable from the adaptor cap 22 to permit the adaptor cap 22 to remain on a pill container when the remainder of the reminder device is used as a compact travel unit. The travel container 36 is a cylindrical receptacle having a compartment 38 in which a small quantity of pills can be stored. The travel container 36 is preferably transparent, but tinted in the same manner as a conventional pill container to protect pills from light, particularly ultra-violet light, which may degrade the medication.

The travel container 36 has a top rim 38 with threads 40 to enable the container portion 26 of the assembly to connect to the alarm and timer cap portion 24. The alarm and timer cap portion 24 comprises a cap unit 42 having a knurled cap member 44 with a threaded recess (not visible) that engages and covers the travel container 36.

The cap member 44 also includes an internal compartment for the timer and alarm electronics. The timer and alarm electronics are mounted in a circuit board with a thin lithium battery for power. The circuit includes an I.C. timer, a piezo-electric sound generator and a small vibrator.

Control of the electronics is accomplished by a twist dial 46 connected to a hub 48 that allows the time period to be selected when a marking 50 is aligned with a position marker 52 on the cap member 44. The twist dial 46 also includes an "off" position 54, which turns the reminder device off to prevent draining the battery.

At the center of the cap unit 42 within the hub 48 is a button switch 56 that starts and/or resets the time period selected by the dial 46. The button switch 56 includes a light in the form of a light emitting diode that is activated when the device is in its alarm mode. The button switch 56 is also used as an alarm mode interrupt to stop the alarm mode and begin the next time period as preset by the dial. In this manner, to avoid annoyance, the alarm signal can be halted by depressing the button, which also restarts the next time period.

The reminder device of this invention comprises a three part assembly that enables the device to be used with a standard pill container or to be separated therefrom utilizing the integral pill compartment for storage of a small quantity of pills in a compact sub-unit.

The reminder device of this invention can be modified to account for time periods that are not regular intervals. However, to maintain a simplicity in operation setting the device should be performed by the pharmacist with options for the user minimized to avoid confusion.

Figure 4:
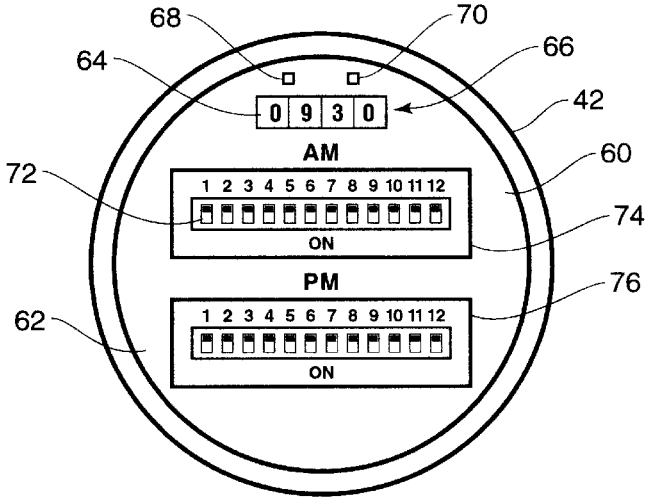
FIG. 4 is a plan view of the underside of an alternate embodiment of the cap unit with a protective disk removed.

In FIG. 4 the cap unit 42 has an underside 60 with a circuit board 62 with back side circuitry (not shown) and front side components including a small liquid crystal display (LCD) 64 of a 24 hour clock 66 having time set buttons 68 and 70 for setting hour and minute, respectively. The 24 hour clock 66 has a 24 hour alarm that activates each hour unless deactivated by a dip switch 72 for a particular hour. In FIG. 4 two micro dip switch components 74 and 76 are provided, each having 12 dip switches 72 for the twelve hours of A.M. and P.M. Each switch 72 is preset in the "off" position as shown, and is selectively switched to an "on" position by the pharmacist. In this manner, the alarm is only activated on the pre-set hours. The twist dial 46, which is not used to set the timer according to the limited settings of the prior embodiment, is used to turn the device "on" and "off", and is used to advance or retard the alarm, for example, in 15 minute increments, up to an hour. In this manner, the user can vary his schedule within controlled limits, to account for the weekend, where the user does not rise as early as the weekday.

Figure 5:
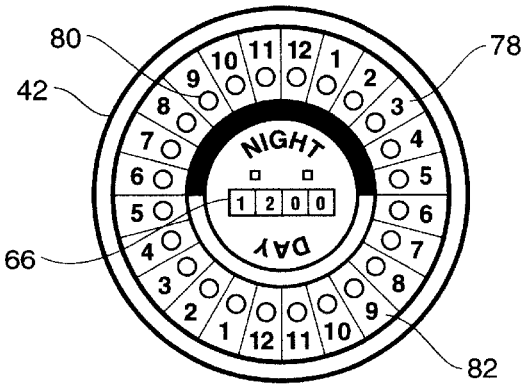
FIG. 5 is a plan view of the underside of another alternate embodiment of the cap unit with a protective disk removed.

In FIG. 5 a further embodiment replaces the micro dip switch components 74 and 76 with a custom pin switch array 78. The pin switch array 78 has 24 pins 80, one for each hour, that are set by pressing a selected pin into a circuit board 82 on which it is mounted.

Figure 6:
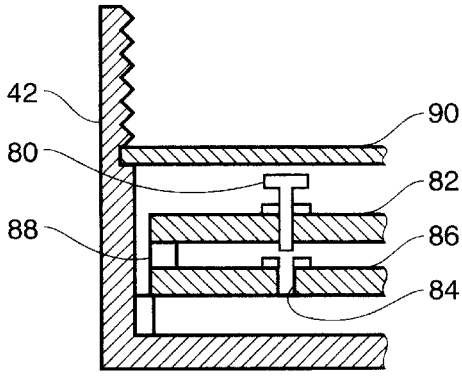
FIG. 6 is an enlarged, partial, cross sectional view of the embodiment of FIG. 5.

The pin 80, as shown in FIG. 6, is mounted on the circuit board 82 and will enter a socket 84 in an adjacent board 86 to complete a circuit to allow the hourly generated alarm signal to pass to the alarm signal elements such as the light, buzzer and/or vibrator. The board 86 is separated from the board 82 by a spacer ring 88, and the switch array is covered by a pop-in disk 90 to hide the array from the user and protect the contents of the travel container portion 26 of the reminder device from the projecting pins.

The use of a pin array 78 provides an inexpensive device for a clearly marked switch system for selective activation of the alarm at any one or more hours set by the pharmacist or other care provider.

Figure 7:
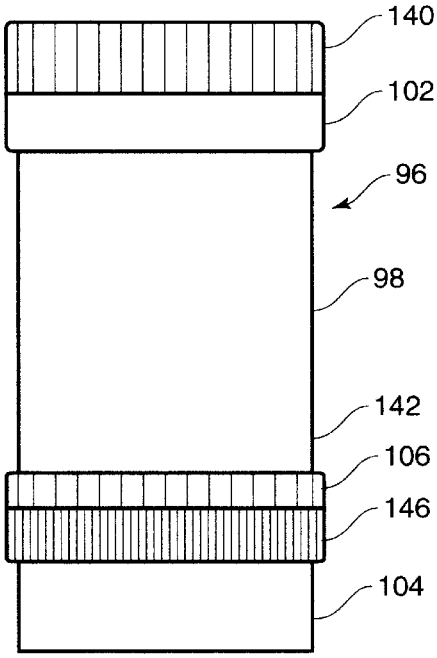
FIG. 7 is a side elevational view of an alternate embodiment of the reminder device that includes the main pill container as part of the embodiment.
Figure 8:
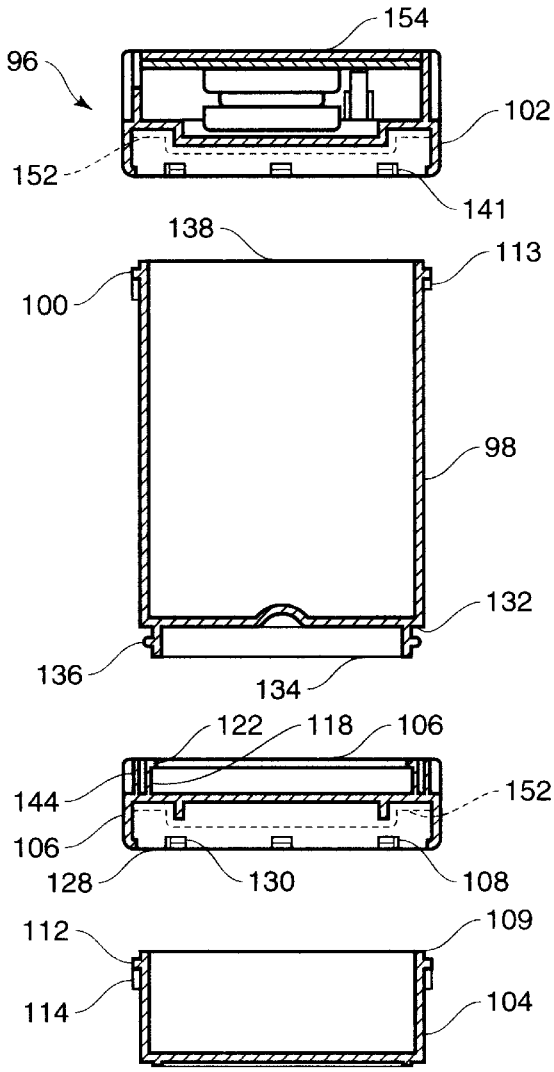
FIG. 8 is a cross-sectional, exploded view of the reminder device of FIG. 7.

In the additional embodiment shown in FIG. 7 a reminder device designated generally by the reference numeral 96 includes components similar to the reminder device 10 of FIG. 1. The reminder device 96 includes a modified prescription container 98 and the complete assembly is shown in FIG. 7 and in the exploded view of FIG. 8.

The modified prescription container 98 has a standard locking mechanism 100 as in a conventional prescription container. The reminder device 96 includes the modified prescription container 98, an electronic cap unit 102, a travel container 104 and an adaptor cap 106. The adaptor cap 106 includes a complimentary internal locking mechanism 108 that also engages the locking mechanism 100 of the modified prescription container 98. To avoid any reluctance to utilize the reminder device 96 because it does not include a safety mechanism for separating the cap components from the open tops of the container components, the travel container 104 has a top rim 109 with a standard locking mechanism 112 in the form of notched teeth 114 identical to the notched teeth 113 forming the locking mechanism 100 of the modified prescription container 98. It is to be understood that the reminder device 96 is provided to the pharmacy with the empty modified prescription container 98 at little additional cost to avoid any compatibility problems in matching the components of the reminder device 96. The reminder device is provided in several standard sizes to accommodate different pill supplies. The prescription container 98 shown is a mid-size container, and a taller container or shorter container having the identical connecting elements provides different capacity alternate containers. Additionally, the cap and containers can be snap-connected without the preferred interlocking mechanism where appropriate.

Figure 9:
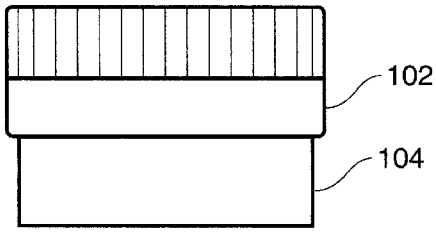
FIG. 9 is a side elevational view of the electronic cap unit installed on the travel container.

The underside 128 of the adaptor cap 106 has a series of projecting bosses 130 around the inside perimeter of the cap to engage the notched teeth 114 of the locking mechanism 108 of the travel container 104 or the notched teeth 113 of the locking mechanism of the modified prescription container 98 in the situation where the electronic cap unit 102 is used with the travel container 104 as shown in FIG. 9.

The modified prescription container 98 is similar to the conventional prescription container 12 of the embodiment of FIG. 1, but with a modified bottom 132, which includes the addition of a projecting ring member 134 with a perimeter bead 136. The upper side 126 of the adaptor cap 106 has an inner ring member 118 with a projecting lip 122 that engages the perimeter bead 136 on the projecting ring member 134 of the modified prescription container 98. This allows the adaptor cap 106 to be snap-connected to or disconnected from the bottom 132 of the prescription container 98. This arrangement allows for greater convenience in the interconnection variations.

For example, the electronic cap unit 102 can be connected to the open top 138 of the modified prescription container 98 with the adaptor cap 106 snap-connected to the bottom 132 of the travel container 104 lock-connected to the underside 128 of the adaptor cap 106 as shown in FIG. 7. The travel container 104 can be snap-disconnected from the prescription container 98 and electronic cap unit 102 and used with the adaptor cap 106 without the electronic reminder feature. Alternately, as noted, the adaptor cap 106 can be switched with the electronic cap unit on the prescription container 98 and the electronic cap unit 102, which has a similar series of projecting bosses 141, can be lock-connected to the travel container 104 as shown in FIG. 9.

The electronic cap unit 102 has a fluted top portion 140 for convenient gripping when removing or installing the cap. Similarly, the adaptor cap 106 has a fluted upper portion 142 on a thick outer ring 144 for continuity and a grooved portion 146 allowing a shallower cut to minimize the diameter of the cap. Both the cap unit 102 and the adaptor cap 106 have a concentric projection 148 and 150 in the underside to seat a seal 152, shown in dotted line, as required.

Figure 10:
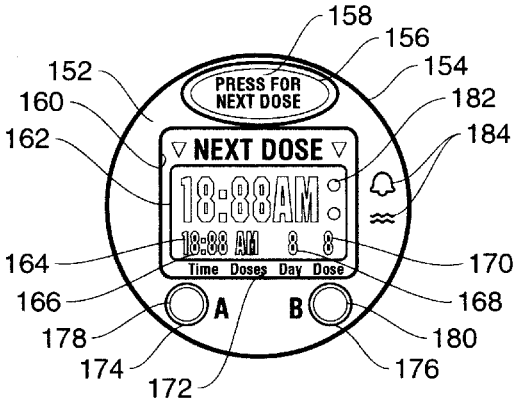
FIG. 10 is a top view of the operating template for the electronic cap unit of FIG. 7.
Figure 11:
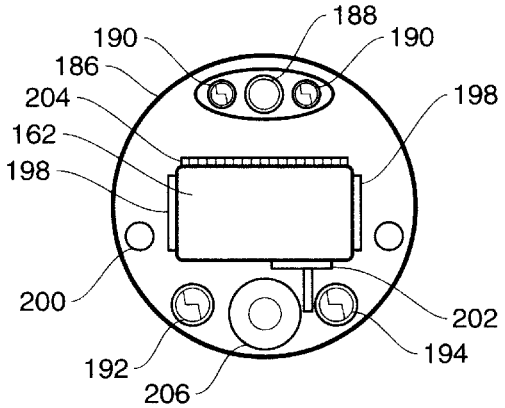
FIG. 11 is a topside view of the circuit board for the electronic cap unit of FIG. 7.
Figure 12:
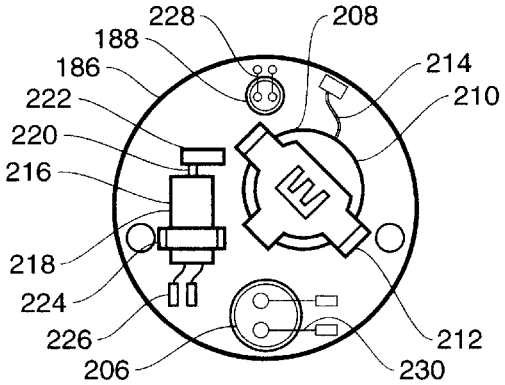
FIG. 12 is an underside view of the circuit board for the electronic cap unit of FIG. 7.

Referring now to FIGS. 10, 11 and 12, the components of the electronic cap are shown. In FIG. 10, a circular top template 152 illustrates the controls for setting and using the reminder device 96. The template 152 is a protective plate 154 with an aperture 156 for the oval push button 158 used by the user to halt a reminder signal and start a period for taking the next dose. A central aperture 160 permits viewing of an LCD display 162 having activatable elements 164 that are selectively activated to indicate the time for the next dose, including whether A.M. or P.M., the real time 166, including A.M. or P.M., the number 168 of doses to be taken in a day and the number 170 of doses taken. Identifying labels 172 on the template 152 assist the user in interpreting the activated elements.

Apertures 174 and 176 are provided for programming buttons 178 and 180, labeled A and B. The programming buttons are initially used by the pharmacist or health care provider to activate the device, set the real time and the number of doses a day, which pre-sets an automatic scheduling routine. Once the provider has pre-set the device for a selected use schedule, the A and B buttons are useable by the user to select between the options of signal light only, signal light and audible alarm, or signal light and vibrator. LCD indicator dots 182 next to graphic icons 184 indicate the selected mode.

Under the template 152 is a circular circuit board 186 on which the electrical components are mounted. The topside of the board 186 is shown in FIG. 11 and includes an LED light 188 under the translucent push button 158 to provide a visual alarm signal. On each side of the light are electrical contacts 190 for the push button 158. Similar contacts 192 and 194 are provided for the programming buttons 178 and 180.

The LCD display 162 is mounted on end blocks 198 adjacent the mounting holes 200 for the circuit board 186. The elevated LCD display 162 allows the processor and accompanying microcircuitry 202 to be mounted on or integrated into the circuit board 186 under the display 162. Connecting band cable 204 on the edge of the LCD display connects the internal display circuitry with the board circuitry.

Between the contacts 192 and 194 for the programming buttons 178 and 180 is an audio alarm generator 206 for producing a beeping sound.

The underside of the circuit board 186 is shown in FIG. 12. On the circuit board is mounted a power supply 208 that includes two 3V batteries 210 and a battery cage 212 that functions as one of the battery terminals. A jumper wire 214 makes contact between the batteries 210 for supplying low voltage to the 3V electronics of the system. The other battery terminal (not visible) is incorporated onto the board under the two stacked batteries 210. Adjacent the power supply 208 is a vibrator generator 216 in the form of a motor 218 with a shaft 220 and an asymmetric board 222. The motor is mounted to the board 186 by a strap 225 and connected to the board circuitry by terminals 226. Terminals 228 and 230 connect the LED light 188 and audio alarm generator 206 to the circuitry.

Figure 13:
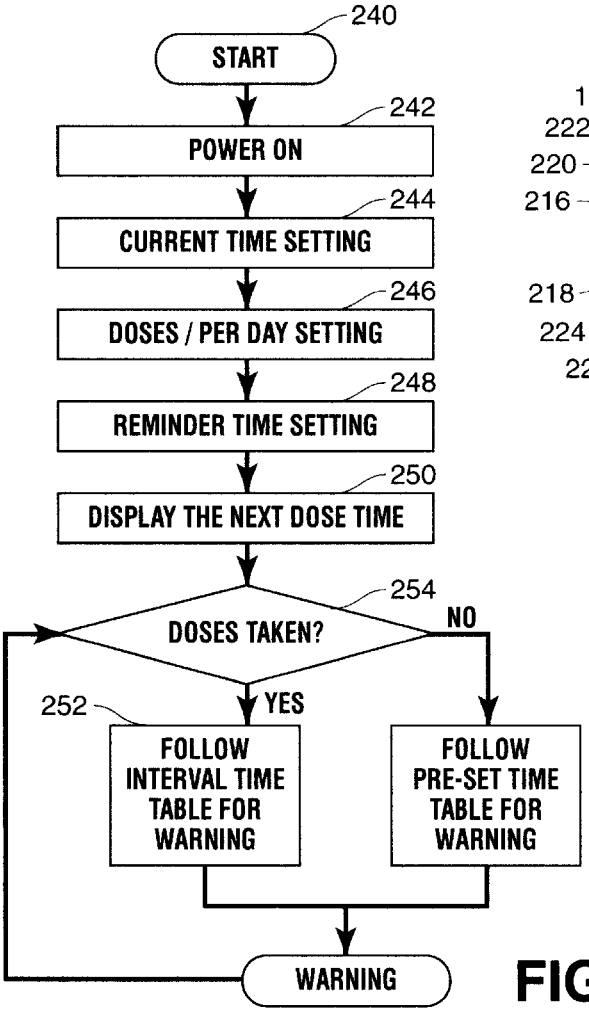
FIG. 13 is a flow chart for the operation of the reminder device of FIG. 7.

Operation of the medication reminder device is outlined in the block diagram of FIG. 13 and described in detail herein.

BOTTLE CAP OPERATION

From the start block 240, the pharmacist powers the device at block 242. Pharmacist then sets the time of day at block 244 and sets the number of doses (1,2,3 or 4) at block 246.

After successfully completing the time and dose settings, the cap beeps and lights three (3) times to confirm the cap is working properly.

Consumer can set the cap for three (3) types of alerts at block 248:

1. Light only (default)
2. Light and Beep
3. Light and Vibrate

Consumer takes the first dose and pushes the light/button. This action sets the caps' programmed timer to alert the consumer the next time a dose is due to be taken at block 250.

When the internal clock senses 12:00 a.m. (Midnight), all interval timing stops. No more reminders for the day occur. At 4 a.m. The light starts blinking to remind the consumer (when they wake) that the first dose of the day needs to be taken. When the consumer takes the first dose and resets the light/button, the pre-programmed intervals begin for the day as indicated at block 252 following choice diamond 254.

If the consumer does not take the first dose by 8 a.m., the beeper starts as an additional reminder as indicated at block 256 following choice diamond 254. The beeper and light continue to signal until 10 a.m. If the consumer does not reset, indicating the first dose was taken, the indicators stop and the next dose reminder will start at the appropriate programmed time. From the warning routine, indicated at block 258, the routine recycles to repeat the process. A summary of the procedure is as follows:

One (1) Dose/Day

Consumer takes a dose and pushes the light/button. This sets the next dose alert to go off in 24 hours. If, after the first day (pharmacy pick up day), the consumer wishes to take the dose each morning, the consumer merely presses the light/button two (2) times consecutively the next morning. This action resets the time interval so the next alert will be 24 hours later (or the next morning). A similar procedure can be done if the dose is taken each morning.

Two (2). Three (3), Four (4) Doses/Day

When the second dose of the day is due, the light/button starts blinking (1 blink indicating 1 dose taken). Consumer has the option to set the cap to beep or vibrate as additional alerts. Consumer pushes the light/button and takes medication. If the second dose is not taken within 1 hour, the cap continues to blink and, in addition, the beeper beeps every 30 seconds for an additional hour. If the light/button is not reset, indicating the dose was taken, after the 2nd hour, all indicators stop and the next dose alert will start at the appropriate pre-programmed time. Light will indicate next pre-programmed dose by blinking (2 blinks when 3rd dose due indicating 2 doses taken). Similar sequences occur for the 3rd and 4th doses.

The following table details the preferred schedule for alarm sequences for one to four doses a day.

| | | | | | |
|---|---|---|---|---|---|
| Pre-Set Time and Time Table for Reminders<br>ALL reminders are in sets of 3:<br>Light - 3 blinks<br>Beeper - 3 beeps<br>Vibrator - 3 vibs.<br>A. ONE (1) TIME/DAY<br>Pre-Set Times and Interval time | | | 1/24/2001 | | |
| DOSE/DAY | PRE-SET | INTERVAL | | | |
| ONE(1) | 4:00 AM | 24 HRS | | | |
| Pre-Set Time & Interval Warning Table<br>Taking Dosage | | | If Dose Not Taken Earlier | | |
| SET | TIME | WARN | SET | TIME | WARN |
| Light | 4 AM–8 AM | LIGHT | Light Only | 6 PM–10 PM | LIGHT |
| | 8 AM–10 AM | LIGHT/BEEP | | 10 PM–12 PM | LIGHT/BEEP |
| Beeper | 4 AM–8 AM | LIGHT | Beeper | 6 PM–10 PM | LIGHT/BEEP |
| | 8 AM–10 PM | LIGHT/BEEP | | | |
| | | | V | | |
| Vibrator | 4 AM–8 AM | LIGHT | Vibrator | 6–6:25 pm | LIGHT/VIBRT* |
| | 8–8:25 AM | LIGHT/VIBRT* | (*25 mins of 1 min. vibrt, 5 min. Off, 1 min. vibrt etc . . . ) | | |
| | 8:25 AM–10 AM | LIGHT | | | |
| B. TWO (2) TIMES/DAY<br>Pre-Set Times and Interval Time | | | | | |
| DOSE/DAY | PRE-SET | INTERVAL | | | |
| TWO(2) | 4:00 AM<br>8:00 PM | 12 HOURS | | | |
| Pre-Set Time Table for Warnings<br>HAVE NOT TAKEN MEDICINE<br>2 TIME/DAY | | | Interval Time Table for Warnings<br>HAVE TAKEN MEDICINE<br>2 TIME/DAY | | |
| SET | TIME | WARN | SET | TIME | WARN |
| | Warning of first time section | | | 12 hr intrvl after key pressed<br>Warning of first time section | |
| | | | *ALWAYS START AT 4:00 AM | | |
| Light | 4 AM–8 AM | LIGHT | Light | 4 hours | LIGHT |
| | 8 AM–10 AM | LIGHT/BEEP | | 2 hours | LIGHT/BEEP |

-continued

| | | | | | |
|---|---|---|---|---|---|
| Beeper | 4 AM–8 AM | LIGHT | Beeper | 4 hours | LIGHT |
| | 8 AM–10 AM | LIGHT/BEEP | | 2 hours | LIGHT/BEEP |
| Vibrator | 4 AM–8 AM | LIGHT | Vibrator | 4 hours | LIGHT |
| | 8–8:25 AM | LIGHT/VIBRT | | 25 Minutes | Light/Vibrt |
| | (25 mins of 1 min. vibrt, 5 min. Off, 1 min. vibrt, etc.) | | | (25 mins of 1 min. vibrt, 5 min. Off, 1 min. vibrt, etc.) | |
| | 8:25 AM–10 AM | LIGHT | | 1 hr 35 min. | LIGHT |
| | | | 12 hr intrvl after key pressed | | |
| Warning of second time section | | | Warning of second time section | | |
| Light | 8 PM–10 PM | LIGHT | Light | 2 hours | LIGHT |
| | 10 PM–11 PM | LIGHT/BEEP | | 1 hour | LIGHT/BEEP |
| Beeper | 8 PM–10 PM | LIGHT/BEEP | Beeper | 2 hours | LIGHT/BEEP |
| | 10 PM–11 PM | LIGHT | | 1 hour | LIGHT |
| Vibrator | 8 PM–825 PM | LIGHT/VIBRT | Vibrator | 25 Minutes | LIGHT |
| | (25 mins of 1 min. vibrt, 5 min. Off, 1 min. vibrt, etc.) | | | (25 mins of 1 min. vibrt, 5 min. Off, 1 min. vibrt, etc.) | |
| | 8:25 PM–11 PM | LIGHT | | 2 hours and 35 min. | |

C. THREE (3) TIMES PER DAY
Pre-Set Times and interval Time

| DOSE/DAY | PRE-SET | INTERVAL |
|---|---|---|
| THREE(3) | 4:00 AM<br>3:00 PM<br>10:00 PM | 6 HOURS |

| Pre-set Time Table for Warnings<br>HAVE NOT TAKEN MEDICINE<br>3 TIMES/DAY | | | Interval Time Table for Warnings<br>HAVE TAKEN MEDICINE<br>3 TIMES/DAY | | |
|---|---|---|---|---|---|
| SET | TIME | WARN | SET | TIME | WARN |
| | Warning of first time section | | | 6 hr intrvl after key pressed<br>Warning of first time section | |
| | | | *ALWAYS START AT 4:00 AM | | |
| Light | 4 AM–8 AM | LIGHT | Light | 4 hours | LIGHT |
| | 8 AM–9 AM | LIGHT/BEEP | | 1 hour | LIGHT/BEEP |
| Beeper | 4 AM–8 AM | LIGHT | Beeper | 4 hours | LIGHT |
| | 8 AM–9 AM | LIGHT/BEEP | | 1 hour | LIGHT/BEEP |
| Vibrator | 4 AM–8 AM | LIGHT | Vibrator | 4 hours | LIGHT |
| | 8–8:25 AM | LIGHT/VIBRT | | 25 mins | LIGHT/BEEP |
| | (25 mins of 1 min. vibrt, 5 min. Off, 1 min. vibrt, etc.) | | | (25 mins of 1 min. vibrt, 5 min. Off, 1 min. vibrt, etc.) | |
| | 8:25 AM–9 AM | LIGHT | | 35 min. | LIGHT |
| | | | 6 hours interval after key pressed | | |
| Warning of second time section | | | Warning of second time section | | |
| Light | 3 PM–4 PM | LIGHT | Light | 1 hour | LIGHT |
| | 4 PM–5 PM | LIGHT/BEEP | | 1 hour | LIGHT/BEEP |
| Beeper | 3 PM–4 PM | LIGHT/BEEP | Beeper | 1 hour | LIGHT/BEEP |
| | 4 PM–5 PM | LIGHT | | 1 hour | LIGHT |
| Vibrator | 3–3:25 PM | LIGHT/VIBRT | Vibrator | 3 PM–3:25 PM | LIGHT/VIBRT |
| | (25 mins of 1 min. vibrt, 5 min. Off, 1 min. vibrt, etc.) | | | (25 mins of 1 min. vibrt, 5 min. Off, 1 min. vibrt, etc.) | |
| | 8:25 AM–10 AM | LIGHT | | 1 hr 35 min. | |
| | | | 6 hr intrvl after key pressed | | |
| Warning of third time section | | | Warning of third time section | | |
| Light | 10 PM–11 PM | LIGHT | Light | 1 hour | LIGHT |
| | 11 PM–12 PM | LIGHT/BEEP | | 1 hour | LIGHT/BEEP |
| Beeper | 10 PM–11 PM | LIGHT/BEEP | Beeper | 1 hour | LIGHT/BEEP |
| | 11 PM–12 PM | LIGHT | | 1 hour | LIGHT |
| Vibrator | 10–10:25 PM | LIGHT/VIBRT | Vibrator | 25 minutes | LIGHT/VIBRT |
| | (25 mins of 1 min. vibrt, 5 min. Off, 1 min. vibrt, etc.) | | | (25 mins of 1 min. vibrt, 5 min. Off, 1 min. vibrt, etc.) | |
| | 10:25 PM–12 PM | LIGHT | | 1 hr 35 min. | |

FOUR (4) TIMES/DAY
Pre-Set Times and Interval time

| DOSE/DAY | PRE-SET | INTERVAL |
|---|---|---|
| FOUR(4) | 4:00 AM<br>12:00 PM<br>5:00 PM<br>10:00 PM | 4 HOURS |

-continued

| Pre-set Time Table for Warnings HAVE NOT TAKEN MEDICINE 4 TIMES/DAY | | | Interval Time Table for Warnings HAVE TAKEN MEDICINE 4 TIMES/DAY | | |
|---|---|---|---|---|---|
| SET | TIME | WARN | SET | TIME | WARN |
| | Warning of first time section | | | 4 hr intrvl after key pressed Warning of first time section *ALWAYS START AT 4:00 AM | |
| Light | 4 AM–8 AM | LIGHT | Light | 4 hours | LIGHT |
| | 8 AM–9 AM | LIGHT/BEEP | | 1 hour | LIGHT/BEEP |
| Beeper | 4 AM–8 AM | LIGHT | Beeper | 4 hours | LIGHT |
| | 8 AM–9 AM | LIGHT/BEEP | | 1 hour | LIGHT/BEEP |
| Vibrator | 4 AM–8 AM | LIGHT | Vibrator | 4 hours | LIGHT |
| | 8–8:25 AM | LIGHT/VIBRT | | 25 minutes | LIGHT/VIBRT |
| | (25 mins of 1 min. vibrt, 5 min. Off, 1 min. vibrt, etc.) | | | (25 mins of 1 min. vibrt, 5 min. Off, 1 min. vibrt, etc.) | |
| | 8:25 AM–9 AM | LIGHT | | 35 min. | LIGHT |
| | | | | 4 hours interval after key pressed | |
| | Warning of second time section | | | Warning of second time section | |
| Light | 12 PM–1 PM | LIGHT | Light | 1 hour | LIGHT |
| | 1 PM–2 PM | LIGHT/BEEP | | 1 hour | LIGHT/BEEP |
| Beeper | 12 PM–1 PM | LIGHT/BEEP | Beeper | 1 hour | LIGHT/BEEP |
| | 1 PM–2 PM | LIGHT | | 1 hour | LIGHT |
| Vibrator | 12–12:25 PM | LIGHT/VIBRT | Vibrator | 25 minutes | LIGHT/VIBRT |
| | (25 mins of 1 min. vibrt, 5 min. Off, 1 min. vibrt, etc.) | | | (25 mins of 1 min. vibrt, 5 min. Off, 1 min. vibrt, etc.) | |
| | 12:25 PM–2 PM | LIGHT | | 1 hr 35 min. | LIGHT |
| | | | | 4 hours interval after c key pressed | |
| | Warning of third time section | | | Warning of second time section | |
| Light | 5 PM–6 PM | LIGHT | Light | 1 hour | LIGHT |
| | 6 PM– | LIGHT/BEEP | | 1 hour | LIGHT/BEEP |
| Beeper | 5 PM–6 PM | LIGHT/BEEP | Beeper | 1 hour | LIGHT/BEEP |
| | 6 PM–7 PM | LIGHT | | 1 hour | LIGHT |
| Vibrator | 5–5:25 PM | LIGHT/VIBRT | Vibrator | 25 minutes | LIGHT/VIBRT |
| | (25 mins of 1 min. vibrt, 5 min. Off, 1 min. vibrt, etc.) | | | (25 mins of 1 min. vibrt, 5 min. Off, 1 min. vibrt, etc.) | |
| | 5:25 PM–7 PM | LIGHT | | 1 hr 35 min. | LIGHT |
| | | | | 4 hours interval after c key pressed | |
| | Warning of fourth time section | | | Warning of fourth time section | |
| Light | 10 PM–11 PM | LIGHT | Light | 1 hour | LIGHT |
| | 11 PM–12 PM | LIGHT/BEEP | | 1 hour | LIGHT/BEEP |
| Beeper | 10 PM–11 PM | LIGHT/BEEP | Beeper | 1 hour | LIGHT/BEEP |
| | 11 PM–12 PM | LIGHT | | 1 hour | LIGHT |
| Vibrator | 10–10:25 PM | LIGHT/VIBRT | Vibrator | 25 minutes | LIGHT/VIBRT |
| | (25 mins of 1 min. vibrt, 5 min. Off, 1 min. vibrt, etc.) | | | (25 mins of 1 min. vibrt, 5 min. Off, 1 min. vibrt, etc.) | |
| | 10:25 PM–12 PM | LIGHT | | 1 hr 35 min. | LIGHT |

From the above it is clear that the different alarm sequences are provided to insure that the user takes the medication by the use of an audio alarm even when the user wishes to select the light only.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A medication reminder device comprising:

a compact pill container having a pill compartment sized to contain a relatively small supply of pills for storage of pills the compartment the compact pill container having an open top providing access to the compartment for deposit and removal of one or more pills and having a bottom;

an electronic cap unit connectable to the open top of the compact pill container at the open top for closure of the compartment when the electronic cap unit is connected to the compact pill compartment, the electronic cap unit having an LCD display; and an adaptor cap having a top and a bottom, wherein the compact container has a bottom and the top of the adaptor cap is connectable to the bottom of the compact pill container, and wherein the adaptor cap has a mechanism at the bottom of the adaptor cap engageable with a conventional pill supply container sized to contain a large supply of pills relative to the compact pill container, wherein the compact container and electronic cap unit are connectable to the conventional pill supply container using the adaptor cap, or separable from the conventional pill supply container and adaptor cap for use of the compact pill container as a travel container for pills with the adaptor cap remaining with the pill supply container covering the conventional pill supply container.

2. The medication reminder device of claim 1, wherein the electronic cap unit has an internal electronics compartment with timer and alarm electronics and has a signal means for generating a signal indicating when a pill is to be taken.

3. The medication reminder device of claim 2, wherein the timer and alarm electronics have means for setting the time an alarm signal is generated.

4. The medication reminder device of claim 2, wherein the signal means includes a button switch for terminating a generated alarm signal.

5. The medication reminder device of claim 4, wherein the button switch includes a light that is activated when the alarm signal is generated.

6. The medication reminder device of claim 5, wherein the button switch resets an alarm period.

7. The medication reminder device of claim 4, wherein the button switch comprises a push button.

8. The medication reminder device of claim 1, having means for selecting a plurality of times for generating an alarm signal.

9. The medication reminder device of claim 8, wherein the means for selecting a plurality of times for generating an alarm signal comprises at least one programming button.

10. The medication reminder device of claim 8, wherein the means for selecting a plurality of times for generating an alarm signal comprises a pair of programming buttons.

11. The medication reminder device of claim 8, wherein the pair of programming buttons additionally selects one of a plurality of selectable alarm modes.

12. The medication reminder device of claim 11, wherein the selectable alarm modes include signal light, signal light and audible alarm, and, signal light and vibrator.

13. The medication reminder device of claim 12, wherein the LCD display includes display means for indicating the selected mode.

14. The medication reminder device of claim 1, in combination with the pill supply container connectable to the adaptor cap and electronic cap unit.

15. The medication reminder device of claim of claim 1, wherein the electronic cap unit includes a processor and accompanying microcircuitry wherein the electronic cap unit is programmed for a method of signaling an alarm comprising the steps of, providing a clock means for determining the time of day, providing a clock setting means for setting the clock means to the correct time of day, providing an alarm setting means associated with the clock means having means for selecting one of a plurality of predetermined multiple alarm intervals during a day, providing an alarm means associated with the alarm setting means for signaling an alarm at a pre-set start time during the day, providing an alarm termination means wherein an alarm terminated by a user activates the next interval for the next alarm wherein the alarm means signals an alarm for a predetermined time before automatically ceasing and activating the interval for the next alarm and wherein at a second pre-set time late at night, all interval timing stops until activated at the pre-set start time during the day.

16. A medication reminder device comprising:

a compact pill container having a pill compartment sized to contain a relatively small supply of pills for storage of pills the compartment the compact pill container having an open top providing access to the compartment for deposit and removal of one or more pills and having a bottom;

an electronic cap unit connectable to the open top of the compact pill container at the open top for closure of the compartment when the electronic cap unit is connected to the compact pill compartment, the electronic cap unit having an LCD display; and an adaptor cap having a top and a bottom, wherein the compact container has a bottom and the top of the adaptor cap is connectable to the bottom of the compact pill container, and wherein the adaptor cap has a mechanism at the bottom of the adaptor cap engageable with a conventional pill supply container sized to contain a large supply of pills relative to the compact pill container, wherein the compact container and electronic cap unit are connectable to the conventional pill supply container using the adaptor cap, or separable from the conventional pill supply container and adaptor cap for use of the compact pill container as a travel container for pills with the adaptor cap remaining with the pill supply container covering the conventional pill supply container, wherein the electronic cap unit has an electronic reminder device in the electronic cap unit with a method of signaling an alarm comprising the steps of, providing a clock means for determining the time of day, providing a clock setting means for setting the clock means to the correct time of day, providing an alarm setting means associated with the clock means having means for selecting one of a plurality of predetermined multiple alarm intervals during a day, providing an alarm means associated with the alarm setting means for signaling an alarm at a pre-set start time during the day, providing an alarm termination means wherein an alarm terminated by a user activates the next interval for the next alarm wherein the alarm means signals an alarm for a predetermined time before automatically ceasing and activating the interval for the next alarm and wherein at a second pre-set time late at night, all interval timing stops until activated at the pre-set start time during the day.

17. The medication reminder device of claim 16, wherein the alarm means includes multiple alarm signals and the user selects at least one of the multiple alarm signals.

18. The medication reminder device of claim 16, wherein the alarm means associated with the alarm setting means for signaling an alarm at a pre-set start time during the day includes a second different alarm signal at a second set time after the pre-set start time.

19. The medication reminder device of claim 18, wherein the two alarm signals continue for a predetermined time and then cease and a next dose reminder will start at a programmed time.

* * * * *